US008405319B2

(12) United States Patent
Sadwick et al.

(10) Patent No.: US 8,405,319 B2
(45) Date of Patent: Mar. 26, 2013

(54) UNIVERSAL DIMMER

(76) Inventors: Laurence P. Sadwick, Salt Lake City, UT (US); William B. Sackett, Sandy, UT (US)

( * ) Notice: Subject to any disclaimer, the term of this patent is extended or adjusted under 35 U.S.C. 154(b) by 233 days.

(21) Appl. No.: 12/776,435

(22) Filed: May 10, 2010

(65) Prior Publication Data

US 2011/0115399 A1 May 19, 2011

Related U.S. Application Data

(60) Provisional application No. 61/176,899, filed on May 9, 2009.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl. ..... 315/291; 315/246; 315/307; 315/308

(58) Field of Classification Search ..... None
See application file for complete search history.

(56) References Cited

U.S. PATENT DOCUMENTS

| | | | | |
|---|---|---|---|---|
| 5,463,280 | A | 10/1995 | Johnson | |
| 6,081,075 | A | 6/2000 | Littlefield | |
| 6,462,485 | B1 | 10/2002 | Kimball | |
| 6,577,512 | B2 | 6/2003 | Tripathi et al. | |
| 6,927,989 | B2 | 8/2005 | Fukumoto | |
| 6,965,205 | B2 | 11/2005 | Piepgras et al. | |
| 7,151,246 | B2 | 12/2006 | Fein et al. | |
| 7,151,345 | B2 | 12/2006 | Sanchez | |
| 7,161,313 | B2 | 1/2007 | Piepgras et al. | |
| 7,178,941 | B2 | 2/2007 | Roberge et al. | |
| 7,183,724 | B2 | 2/2007 | Ball | |
| 7,202,613 | B2 | 4/2007 | Morgan et al. | |
| 7,256,554 | B2 | 4/2007 | Lys | |
| 7,233,115 | B2 | 6/2007 | Lys | |
| 7,262,559 | B2 | 8/2007 | Tripathi et al. | |
| 7,276,861 | B1 | 10/2007 | Shteynberg | |
| 7,298,095 | B2 | 11/2007 | Nukisato et al. | |
| 7,358,706 | B2 | 4/2008 | Lys | |
| 7,378,805 | B2 | 5/2008 | Oh et al. | |
| 7,459,864 | B2 | 12/2008 | Lys | |
| 7,511,437 | B2 | 3/2009 | Lys et al. | |
| 8,148,907 | B2 * | 4/2012 | Sadwick et al. | 315/246 |
| 2006/0170373 | A1 | 8/2006 | Yang | |
| 2008/0067953 | A1 | 3/2008 | Kranz | |
| 2008/0081423 | A1 | 4/2008 | Sadwick et al. | |
| 2008/0284346 | A1 | 11/2008 | Lee | |

* cited by examiner

*Primary Examiner* — Anh Tran
(74) *Attorney, Agent, or Firm* — Hamilton, DeSanctis & Cha

(57) ABSTRACT

Various embodiments of a universal dimmer are disclosed. In one embodiment of a universal dimmer, a power limiting switch is connected to an input voltage. An output driver in the universal dimmer includes a power input and a load path, with the power input being connected to the input voltage. A variable pulse generator includes a control input and a pulse output, with the control input connected to a control input of the power limiting switch. The pulse output is connected to a control input of the power limiting switch. The variable pulse generator is adapted to effectively vary a duty cycle at the pulse output. The universal dimmer also includes a load current detector having an input and an output. The load current detector input is connected to the output driver load path. The load current detector output is connected to the variable pulse generator control input. The variable pulse generator and the load current detector are adapted to limit the effective duty cycle when a load current reaches a maximum current limit to substantially prevent the load current from exceeding the maximum current limit.

16 Claims, 11 Drawing Sheets

UNIVERSAL DIMMER

CROSS REFERENCE TO RELATED APPLICATIONS

The present application claims priority to U.S. Patent Application No. 61/176,899 entitled "Universal Dimmer", filed May 9, 2009, the entirety of which is incorporated herein by reference for all purposes.

BACKGROUND

Electricity is generated and distributed in alternating current (AC) form, wherein the voltage varies sinusoidally between a positive and a negative value. However, many electrical devices require a direct current (DC) supply of electricity having a constant voltage level, or at least a supply that remains positive even if the level is allowed to vary to some extent. For example, light emitting diodes (LEDs) and similar devices such as organic light emitting diodes (OLEDs) are being increasingly considered for use as light sources in residential, commercial and municipal applications. However, in general, unlike incandescent light sources, LEDs and OLEDs cannot be powered directly from an AC power supply unless, for example, the LEDs are configured in some back to back formation. Electrical current flows through an individual LED easily in only one direction, and if a negative voltage which exceeds the reverse breakdown voltage of the LED is applied, the LED can be damaged or destroyed. Furthermore, the standard, nominal residential voltage level is typically something like 120 V or 240 V, both of which are higher than may be desired for a high efficiency LED light. Some conversion of the available power may therefore be necessary or highly desired with loads such as an LED light.

In one type of commonly used power supply for loads such as an LED, an incoming AC voltage is connected to the load only during certain portions of the sinusoidal waveform. For example, a fraction of each half cycle of the waveform may be used by connecting the incoming AC voltage to the load each time the incoming voltage rises to a predetermined level or reaches a predetermined phase and by disconnecting the incoming AC voltage from the load each time the incoming voltage again falls to zero. In this manner, a positive but reduced voltage may be provided to the load. This type of conversion scheme is often controlled so that a constant current is provided to the load even if the incoming AC voltage varies. However, if this type of power supply with current control is used in an LED light fixture or lamp, a conventional dimmer is often ineffective. For many LED power supplies, the power supply will attempt to maintain the constant current through the LED despite a drop in the incoming voltage by increasing the on-time during each cycle of the incoming AC wave.

Dimmer circuits are generally used to regulate the illumination level output from a light by controlling the current, voltage or power available to the light through any of a number of mechanisms or regulation schemes. Dimmer circuits may also be used with other types of loads to control the work performed by the load. Dimmer circuits are typically designed to operate with a specific input voltage. If they are used with a different input voltage, current may rise above safe levels and damage loads such as LEDs. The behavior of the dimmer circuit may also be altered, with the dimming range being compressed or expanded.

SUMMARY

A universal dimmer is disclosed which variably controls an output up to a certain level, above which the output is regulated at a constant level. For example, in a current controlling dimmer, provided an input voltage of up to 120V, the average output current may be adjusted up or down to make a lamp brighter or dimmer, and provided an input voltage above 120V, such as 220V, the output current is regulated at a fixed level, such as a level that sets the lamp at a normal fully on illumination level. The universal dimmer may be adapted to any type of regulation scheme, such as current control, voltage control, DC output, AC output with various types of waveforms and modulations, etc. For example, an AC output may be dimmed using phase control, amplitude modulation and truncation, or any other means. The level at which the universal dimmer switches from a dimming mode to a constant output mode can be at a fixed predetermined level or may be dynamically determined by any suitable determination system, such as the state of a manually or automatically operated switch, monitoring the electrical characteristics of the output or input, temperature or light sensors, etc. and adjusting parameters in the universal dimmer accordingly, etc.

In one embodiment of a universal dimmer, a power limiting switch is connected to an input voltage. An output driver in the universal dimmer includes a power input and a load path, with the power input being connected to the input voltage. A variable pulse generator includes a control input and a pulse output, with the control input connected to a control input of the power limiting switch. The pulse output is connected to a control input of the power limiting switch. The variable pulse generator is adapted to vary a duty cycle at the pulse output. The universal dimmer also includes a load current detector having an input and an output. The load current detector input is connected to the output driver load path. The load current detector output is connected to the variable pulse generator control input. The variable pulse generator and the load current detector are adapted to limit the duty cycle when a load current reaches a maximum current limit to substantially prevent the load current from exceeding the maximum current limit.

BRIEF DESCRIPTION OF THE DRAWINGS

A further understanding of the various embodiments may be realized by reference to the figures which are described in remaining portions of the specification. In the figures, like reference numerals may be used throughout several drawings to refer to similar components.

DESCRIPTION

Figure 1:
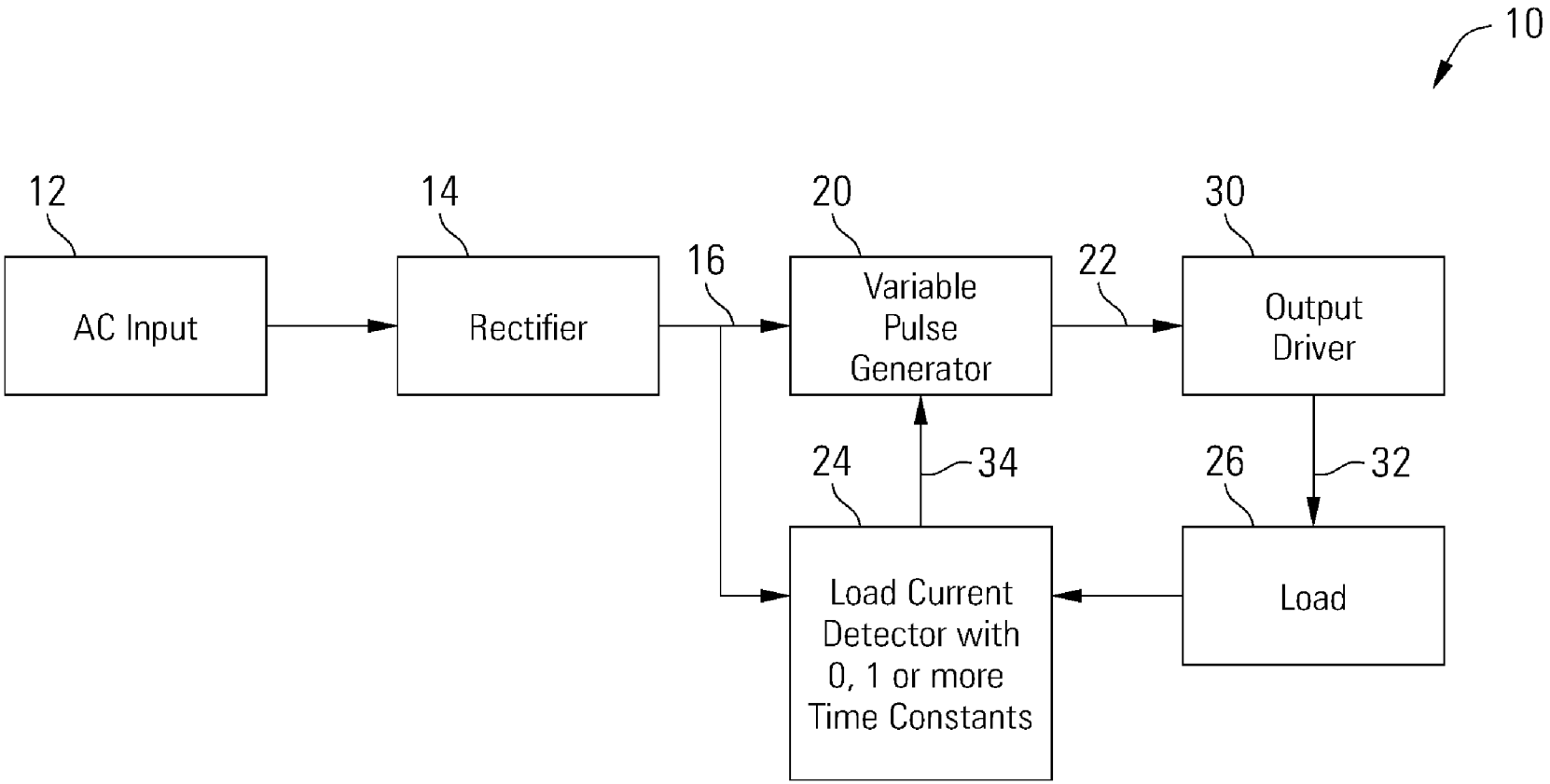
FIG. 1 depicts a block diagram of a universal dimmer power supply/driver in accordance with some embodiments.

Dimming drivers are typically designed for use over a relatively narrow input voltage range and are typically not protected from damage at other voltages outside the relatively narrow voltage range. The present invention addresses this and other limitations and provides a circuit for driving various loads including, but not limited to, light emitting diodes (LEDs) of all types with some examples being high brightness LEDs, arrays of LEDs and organic LEDs (OLEDs); it is also possible to apply the present invention to dimming fluorescents, incandescent, gas discharge, neon, and/or any combination of lighting, etc. The driver circuit is designed to be able to switch from dimming mode to universal operation. In one embodiment such a dimming to universal constant current driver/power supply can be realized and implemented with both high power factor during dimming and also high power factor when in the saturated set point constant output current universal input voltage mode.

Such a switch/change in modes can be accomplished by a number of methods including manual mode via, for example, a switch that can be manually moved to change the value of a circuit component or parameter such as a resistor or voltage, respectively, to change the circuit operation from a constant current regardless of the input voltage (peak, average, etc.) within reasonable limits to a circuit operation that responds to input values and in particular the input voltage whether the peak, average or some combination of such values, etc. Such a dimming operation may have multiple states and conditions, for example, there could be three choices to select from: dimming in a range of lower voltages (i.e., 90 to 125 VAC or a more narrow range, etc.), universal input with constant current or constant voltage, and dimming in a range of higher voltages (i.e., 200 to 220 VAC, 220 to 240 VAC, or a more narrow range, etc.). Although a typical application may use AC, the input voltage could be AC and/or DC.

Such a dimming to universal control may be hardwired into the present invention, be software selectable, be programmed either internally or externally by any method including wireless, wired, optical control, etc., by a switch of any type, either located on the actual light source or elsewhere, by either simple or complex control algorithms, either contained internally within the light source or remote from the light source. The present invention can be implemented in a dimming to constant output mode, a universal dimmer, and numerous other embodiments and implementations that, again, can be manually switched from one mode to another, automatically switched from one mode to another, programmed by a variety of ways including by firmware, hardware, software, wired communications, wireless communications, etc.

In addition, a fast or extremely fast over current, over voltage control signal or signals may be used to limit any parameter or combination of parameters such as voltage, current, power in an instantaneous method and approach to protect the light source from, for example, transients, surges, over-voltages, harmonics, other distortions, etc. that may exist on the line input voltage, from time to time or continuously. Such fast methods of control may or may not preserve the high power factor and may depend on the characteristics and behavior of the input signal; however, in general, preserving the power factor is preferred.

An example of how to implement the present invention can be realized by providing a reference signal, for example, a reference voltage or current that can be varied with the average or instantaneous input voltage until a maximum level after which the reference voltage or current reaches a maximum level resulting, for example, in a constant output current or constant output voltage that is now independent of, for example, the input voltage and becomes a/transforms the light source into a constant output light independent of the input waveforms, levels, etc. above a certain prescribed (but also potentially programmable) input level(s) and associated conditions.

Such a reference signal may consist of, for example, a voltage divider voltage that is directly related to, for example, the peak, instantaneous, average, etc. voltage of the input which can be clamped/clipped/limited to a maximum value, by any means. Examples of such clamping/clipping/limiting/etc. can be a Zener diode in parallel with one of the resistors used in a voltage dividing network, the current obtained from a series pass transistor circuit either in a current mirror or other configuration, reaching the rail voltage of an operational amplifier or other such active device, reaching the maximum duty cycle of a digitally controlled signal, reaching the maximum pulse width modulation (PWM), reaching the maximum of an analog and/or digital signal, etc.

Such a dimmer to universal system may be used for other types of loads other than lighting and could include, for example, motors, fans, heaters, and a vast collection of varied and diverse loads and applications.

The present invention can be configured in numerous and diverse ways, methods, topologies, approaches, etc. ranging from simple to extremely complex. Buck, boost, boost-buck, buck-boost, CUK, SEPIC, discontinuous conduction mode, critical conduction mode, continuous conduction mode, resonant circuits, etc. can all be used to implement the present invention and the present invention can be used with all of these to realize dimmable to constant output power supply/driver performance.

As mentioned above, the present invention can be implemented in a number of power supply and driver circuits, including in general, but not limited to, buck, boost, buck-boost, boost-buck, single stage, Ćuk, power supplies, both with and without power factor correction, etc. Such dimming to universal control can be accomplished in both isolated and non-isolated designs and implementations, including on the output side and/or the input side of the circuit. The present invention can involve having appropriate time constants on the input side and/or the output side and monitoring and controlling one or more signals.

The present invention may involve one or more time constants and control loops to accomplish and implement the dimming to universal voltage input control. It may involve any combination of time constants, delays, fast and ultrafast response circuits whether digital or analog in nature. The present invention may use circuitry to limit or modify, for example, a pulse that drives a transistor to provide either isolated (e.g., transformer) or non-isolated (e.g. inductor) power transfer to output load or it may, for example, digitally modulate, turn on/off, (pulse width modulate) PWM the pulse to the transistor associated with the transformer, inductor, etc. The present invention includes all types of transformer topologies found in both switching and linear power supplies including, but not limited to, flyback and same primary/secondary polarity transformer configurations and topologies.

The present invention can be implemented using constant on time, constant off time, constant frequency/period, constant pulse width, constant duty cycle, or, if preferred, variable on-time, off-time, frequency, etc. can be used to realize and implement the present invention. In addition, dither can be employed to reduce the effects of electromagnetic interference (EMI).

Referring now to FIG. 1, a block diagram of an embodiment of a universally dimming power supply or universal dimmer 10 is shown. In this embodiment, the universal dimmer 10 is powered by an AC input 12, for example by a 50 or 60 Hz sinusoidal waveform of 120 V or 240 V RMS such as that supplied to residences by municipal electric power companies. It is important to note, however, that the universal dimmer 10 is not limited to any particular voltage, current or power input, and that the universal dimmer may be adapted to operate with any input voltage or with various different input voltages including DC input voltages. The universal dimmer 10 may be adapted to dim, that is, provide increasing output current as the input voltage increases, up to a certain maximum output current, at which point the output current will remain substantially constant as the input voltage continues to increase. In another embodiment, the universal dimmer 10 may be adapted to sense which of a number of input voltages or input voltage ranges are applied and to switch the dimming range dynamically. In still another embodiment, the universal dimmer may be adapted to sense the on-time of, for example, phase dimmers such as triacs and the likes, using both forward and reverse phase dimming, to provide a universal dimming driver behavior that is independent of the actual AC (or DC) input voltage up to a predetermined maximum (for example, phase dimming of the output current from less than 100 V AC up to 277 V AC after which the output current remains at a constant value).

The AC input 12 is connected to a rectifier 14 to rectify and invert any negative voltage component from the AC input 12. Although the rectifier 14 may filter and smooth the power output 16 if desired to produce a DC signal, this is not necessary and the power output 16 may be a series of rectified half sinusoidal waves at a frequency double that at the AC input 12, for example 120 Hz. A variable pulse generator 20 is powered by the power output 16 from the AC input 12 and rectifier 14 to generate a train of pulses at an output 22. The variable pulse generator 20 may be adapted to enable the universal dimmer 10 to operate with various different input voltages or input voltage ranges, either monitoring the input voltage and dynamically selecting appropriate dimming ranges, or by limiting the maximum output current regardless of input voltage. The variable pulse generator 20 may comprise any device or circuit now known or that may be developed in the future to generate a train of pulses of any desired shape. For example, the variable pulse generator 20 may comprise devices such as comparators, amplifiers, oscillators, counters, frequency generators, ramp circuits and generators, digital logic, analog circuits, application specific integrated circuits (ASIC), microprocessors, microcontrollers, state machines, digital logic, field programmable gate arrays (FPGAs), complex logic devices (CLDs), timer integrated circuits, etc. One non-limiting example of a variable pulse generator 20 according to one embodiment will be described in more detail below with respect to FIG. 10.

The pulse width of the train of pulses is controlled by a load current detector 24 having 0, 1 or more time constants depending on the specifics of the driver implementations. In one embodiment, the load current detector 24 does not begin to restrict the pulse width until the current through the load 26 has reached a maximum allowable level. Various implementations of pulse width control including pulse width modulation (PWM) by frequency, analog and/or digital control may be used to realize the pulse width control. Other features such as soft start, delayed start, instant on operation, etc. may also be included if deemed desirable, needed, and/or useful. An output driver 30 produces a current 32 through the load 26, with the current level adjusted by the pulse width at the output 22 of the variable pulse generator 20. The current 32 through the load 26 is monitored by the load current detector 24. The current monitoring performed by the load current detector 24 may be done with one or more time constants if desired that includes information about voltage changes at the power output 16 of the rectifier 14 slower than or on the order of a waveform cycle at the power output 16, but not faster changes at the power output 16 or voltage changes at the output 22 of the variable pulse generator 20. The control signal 34 from the load current detector 24 to the variable pulse generator 20 thus varies with slower changes in the power output 16 of the rectifier 14, but not with the incoming rectified AC waveform or with changes at the output 22 of the variable pulse generator 20 due to the pulses themselves. In one particular embodiment, the load current detector 24 includes one or more low pass filters to implement the time constant used in the load current detection. The time constant may be established by a number of suitable devices and circuits, and the universal dimmer 10 is not limited to any particular device or circuit. For example, the time constant may be established using RC circuits arranged in the load current detector 24 to form low pass filters, or with other types of passive or active filtering circuits. The load 26 may be any desired type of load, such as a light emitting diode (LED) or an array of LEDs arranged in any configuration. For example, an array of LEDs may be connected in series or in parallel or in any desired combination of the two. The load 26 may also be an organic light emitting diode (OLED) in any desired quantity and configuration. The load 26 may also be a combination of different devices if desired, and is not limited to the examples set forth herein. Hereinafter, the term LED is used generically to refer to all types of LEDs including OLEDs and is to be interpreted as a non-limiting example of a load. The time constants can be located in a number of ways and places in the circuit including on the input side or the output side or both. There may only be fast or no time constant circuits, only time constant circuits on the input side, only time constant circuits on the output side, no time constants, or any combination including combinations of the above. Comparators may be used instead of operational amplifiers or operational amplifiers may be used in the present invention.

Figure 2:
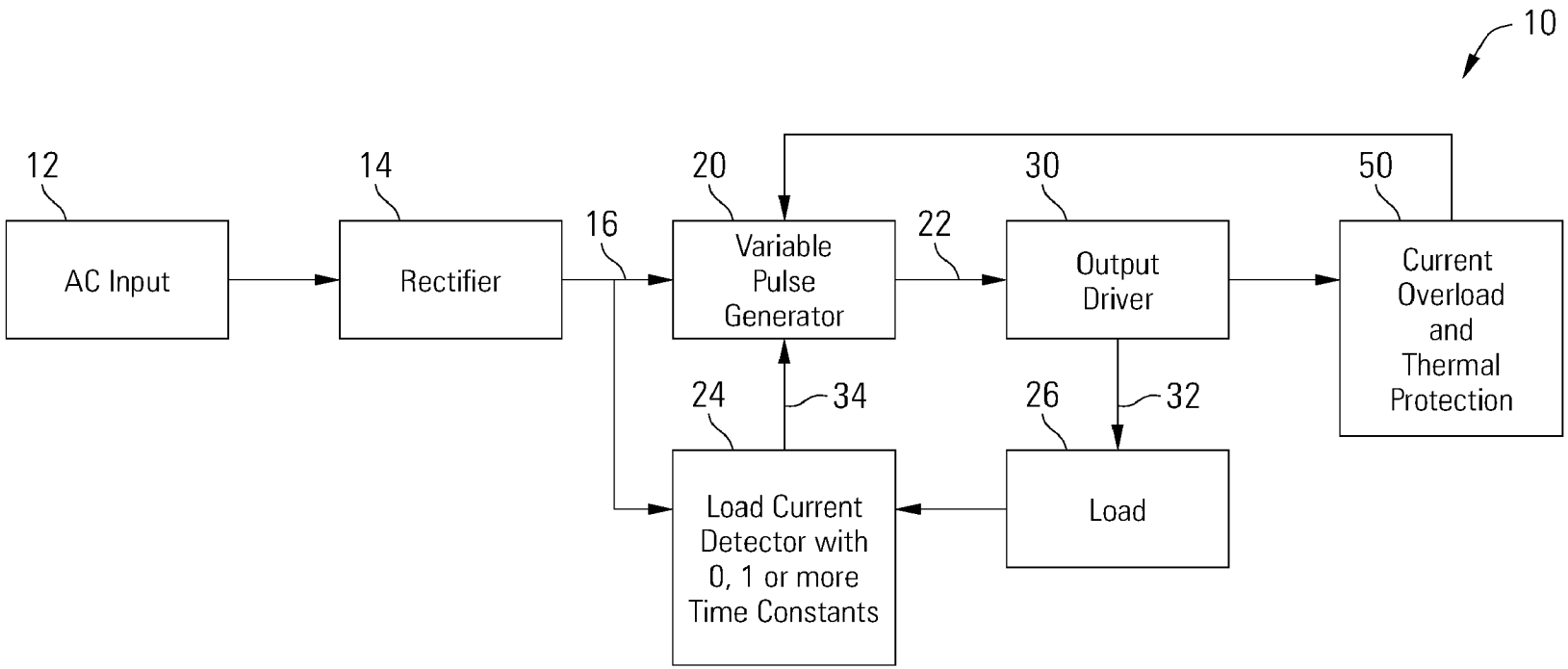
FIG. 2 depicts a block diagram of a universal dimmer power supply/driver with current overload and thermal protection.

Some embodiments of the universal dimmer 10 may include current overload protection and/or thermal protection 50, as illustrated in FIG. 2. As an example, the current overload protection 50 measures the current through the universal dimmer power supply/driver 10 and narrows or turns off the pulses at the output 22 of the variable pulse generator 20 if the current exceeds a threshold, maximum, limit, etc. value. (The universal dimmer power supply/driver 10 is also referred to herein simply as a universal dimmer.) The current detection for the current overload protection 50 may be adapted as desired to measure instantaneous current, average current, or any other measurement desired and at any desired location in the universal dimmer 10. Thermal protection 50 may also be included to narrow or turn off the pulses at the output 22 of the variable pulse generator 20 if the temperature in the universal dimmer 10 becomes excessive, thereby reducing the power through the universal dimmer 10 and allowing the universal dimmer 10 to cool. The thermal protection may also be designed and implemented such that at a prescribed temperature, the pulses are turned off which effectively disables the power supply and turns off the output to the load. The temperature sensor can be any type of temperature sensitive element including semiconductors such as diodes, transistors, etc. and/or thermocouples, thermistors, bimetallic elements and switches, etc.

Figure 3:
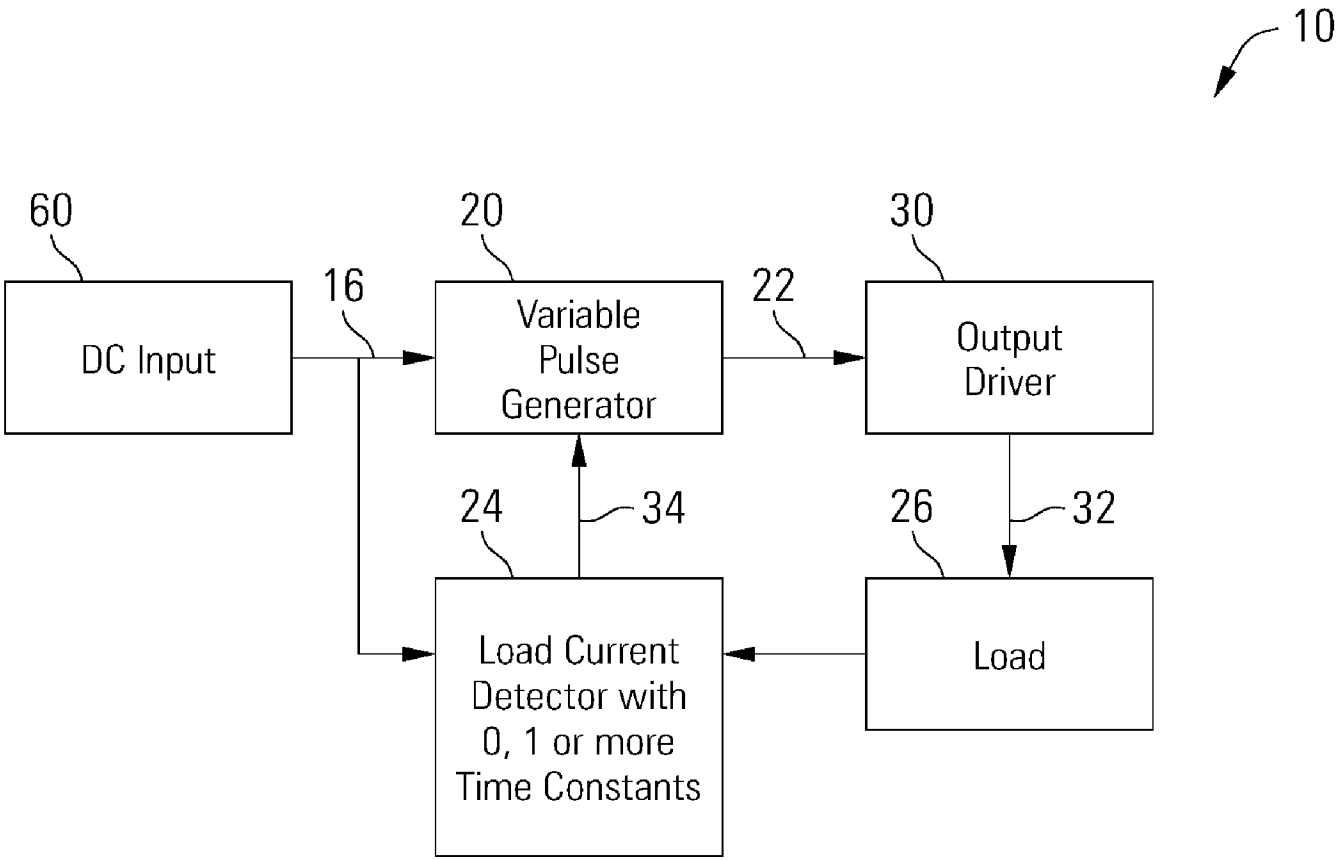
FIG. 3 depicts a block diagram of a universal dimmer power supply/driver with a DC input.

As discussed above, the universal dimmer 10 may be powered by any suitable power source, such as the AC input 12 and rectifier 14 of FIG. 1, or a DC input 60 as illustrated in FIG. 3. Time constants in the universal dimmer 10 are adapted to produce pulses in the output 22 of the variable pulse generator 20 having a constant width across the input voltage waveform from a rectified AC input 12, thereby maintaining a good power factor, while still being able to compensate for slower changes in the input voltage to provide a constant load current.

Figure 4:
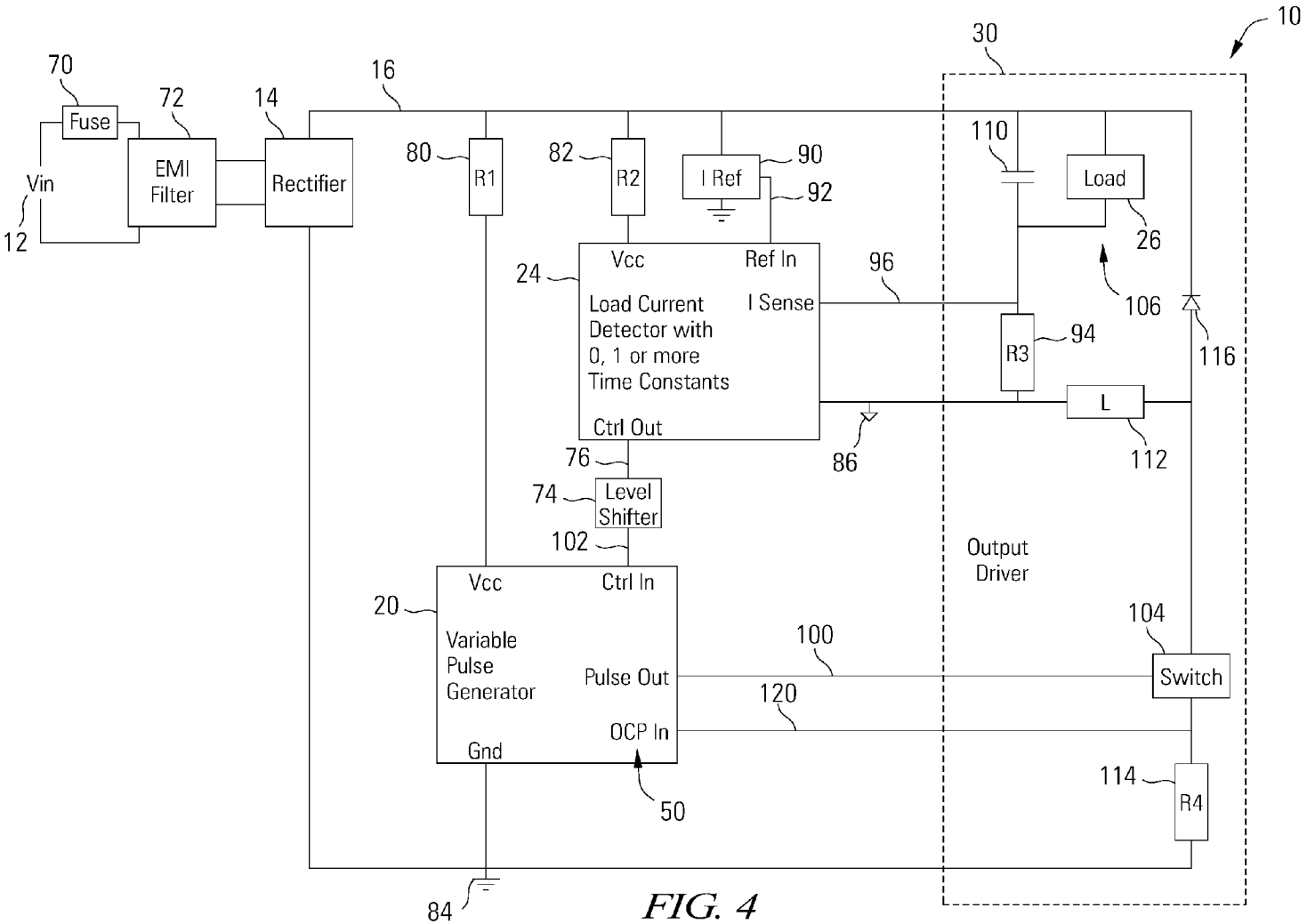
FIG. 4 depicts a block diagram of a universal dimmer power supply/driver in accordance with some embodiments.

Referring now to FIG. 4, the universal dimmer 10 will be described in more detail. In the diagram of FIG. 4, the load 26 is shown inside the output driver 30 for convenience in setting forth the connections in the diagram. An AC input 12 is shown, and is connected to the universal dimmer 10 in this embodiment through a fuse 70 and an electromagnetic interference (EMI) filter 72. The fuse 70 may be any device suitable to protect the universal dimmer 10 from overvoltage or overcurrent conditions, such as a traditional meltable fuse or other device (e.g., a small low power surface mount resistor), a circuit breaker including a solid state circuit breaker, etc. The EMI filter 72 may be any device suitable to prevent EMI from passing into or out of the universal dimmer 10, such as a coil, inductor, capacitor and/or other components and/or any combination of these, or, also in general, a filter, etc. The AC input 12 is rectified in a rectifier 14 as discussed above. In other embodiments, the universal dimmer 10 may use a DC input as discussed above. In this embodiment, the universal dimmer 10 may generally be divided into a high side portion including the load current detector 24 and a low side portion including the variable pulse generator 20, with the output driver 30 spanning or including the high and low side. In this case, a level shifter 74 may be employed between the load current detector 24 in the high side and the variable pulse generator 20 in the low side to communicate the control signal 76 to the variable pulse generator 20. The variable pulse generator 20 and load current detector 24 are both powered by the power output 16 of the rectifier 14, for example through resistors 80 and 82, respectively. The high side, including the load current detector 24, floats at a high potential under the voltage of the input voltage 16 and above the circuit ground 84. A local ground 86 is thus established and used as a reference voltage by the load current detector 24.

A reference current source 90 supplies a reference current signal 92 to the load current detector 24, and a current sensor such as a resistor 94 provides a load current signal 96 to the load current detector 24. The reference current source 90 may use the circuit ground 84 as illustrated in FIG. 4, or the local ground 86, or both, or some other reference voltage level as desired. The load current detector 24 compares the reference current signal 92 with the load current signal 96, optionally using one or more time constants to effectively average out and disregard current fluctuations due to any waveform at the input voltage 16 and pulses from the variable pulse generator 20, and generates the control signal 76 to the variable pulse generator 20. The variable pulse generator 20 adjusts the pulse width of a train of pulses at the pulse output 100 of the variable pulse generator 20 based on the level shifted control signal 102 from the load current detector 24, which is activated when the current through the load 26 has reached a maximum level. The level shifter 74 shifts the control signal 76 from the load current detector 24 which is referenced to the local ground 86 in the load current detector 24 to a level shifted control signal 102 that is referenced to the circuit ground 84 for use in the variable pulse generator 20. The level shifter 74 may comprise any suitable device for shifting the voltage of the control signal 76, such as an opto-isolator or opto-coupler, resistor, transformer, transistors, etc. The use of a isolated level shifter such as a optocoupler or optoisolator or transformer may be desired, required and/or beneficial for certain applications.

The pulse output 100 from the variable pulse generator 20 drives a switch 104 such as a field effect transistor (FET) in the output driver 30. When a pulse from the variable pulse generator 20 is active, the switch 104 is turned on, drawing current from the input voltage 16, through the load path 106 (and an optional capacitor 110 connected in parallel with the load 26), through the load current sense resistor 94, an inductor 112 in the output driver 30, the switch 104, and a current sense resistor 114 to the circuit ground 84. When the pulse from the variable pulse generator 20 is off, the switch 104 is turned off, blocking the current from the input voltage 16 to the circuit ground 84. The inductor 112 resists the current change and recirculates current through a diode 116 in the output driver 30, through the load path 106 and load current sense resistor 94 and back to the inductor 112. The load path 106 is thus supplied with current alternately through the switch 104 when the pulse from the variable pulse generator 20 is on and with current driven by the inductor 112 when the pulse is off. The pulses from the variable pulse generator 20 have a relatively much higher frequency than variations in the input voltage 16, such as for example 30 kHz or 100 kHz as compared to the 100 Hz or 120 Hz that may appear on the input voltage 16 from the rectified AC input 12.

Note that any suitable frequency for the pulses from the variable pulse generator 20 may be selected as desired, with the optional time constant or time constants in the load current detector 24 being selected accordingly to disregard load current changes due to the pulses from the variable pulse generator 20 while tracking changes on the input voltage 16 that are slower than or on the order of the waveform on the input voltage 16. Changes in the current through the load 26 due to the pulses from the variable pulse generator 20 may be smoothed in the optional capacitor 110, or may be ignored if the load is such that high frequency changes are acceptable. For example, if the load 26 is an LED or array of LEDs, any flicker that may occur due to pulses at many thousands of cycles per second will not be visible to the eye. In the embodiment of FIG. 4, a current overload protection 50 is included in the variable pulse generator 20 and is based on a current measurement signal 120 by the current sense resistor 114 connected in series with the switch 104. If the current through the switch 104 and the current sense resistor 114 exceeds a threshold value set in the current overload protection 50, the pulse width at the pulse output 100 of the variable pulse generator 20 will be reduced or eliminated. The present invention is shown implemented in the discontinuous mode;

however with appropriate modifications operation under continuous or critical conduction modes and other modes can also be realized.

Figure 5:
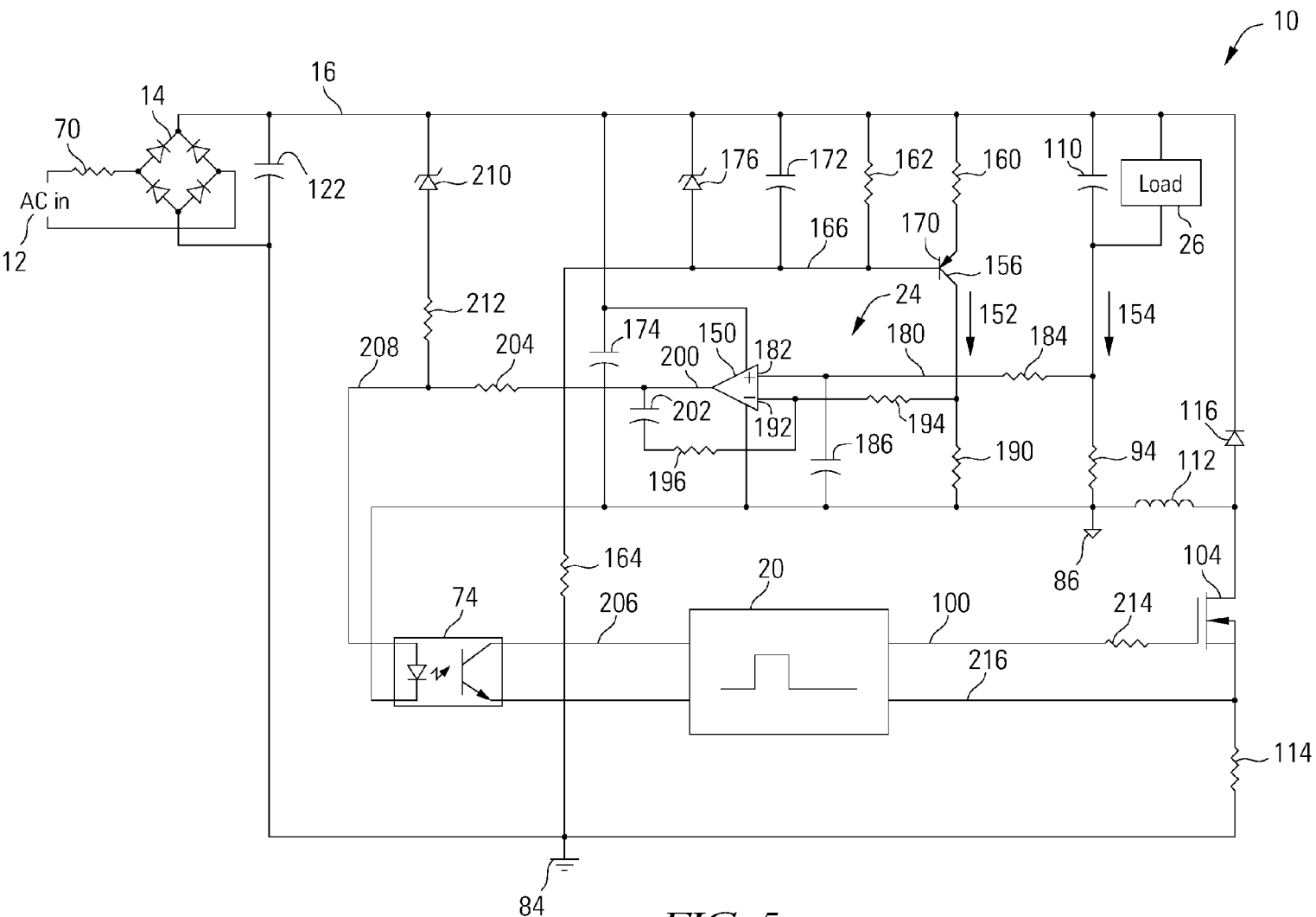
FIG. 5 depicts a schematic of a universal dimmer power supply/driver in accordance with some embodiments.

Referring now to FIG. 5, a schematic of one embodiment of the universal dimmer 10 will be described. In this embodiment, an AC input 12 is used, with a resistor included as a fuse 70, and a diode bridge as a rectifier 14. Some smoothing of the input voltage 16 may be provided by a capacitor 122, although it is not necessary as described above. A variable pulse generator 20 is used to provide a stream of pulses at the pulse output 100. As described above, the variable pulse generator 20 may be embodied in any suitable device or circuit for generating a stream of pulses. Those pulses may have any suitable shape, such as substantially square pulses, semi-sinusoidal, triangular, etc. although square or rectangular are the most common in driving field effect transistors. The frequency of the pulses may also be set at any desired level, such as 30 kHz or 100 kHz, or higher, etc. that enable the load current detector 24 to disregard changes in a load current due to the pulses input waveform and also realize a very high power factor approaching unity. The width of the pulses is controlled by the load current detector 24 once a maximum load current is reached, limiting the load current to the maximum even if the input voltage rises higher than needed to provide the maximum output current. For example, in one embodiment, the maximum pulse width is set at about one tenth of a pulse cycle. This may be interpreted from one point of view as a 10 percent duty cycle at maximum pulse width. However, the universal dimmer 10 is not limited to any particular maximum pulse width and, for that matter, the universal power supply driver can be implemented using a constant on-time, a constant off-time, a constant period, etc.

The variable pulse generator 20 is powered from the input voltage 16 by any suitable means including, but not limited to, a bias circuit from the rectified AC lines, bias coils in transformers, etc. Because a wide range of known methods of reducing or regulating a voltage are known, the power supply for the variable pulse generator 20 from the input voltage 16 is not shown in FIG. 5. For example, a voltage divider or a voltage regulator may be used to drop the voltage from the input voltage 16 down to a useable level for the variable pulse generator 20.

In one particular embodiment illustrated in FIG. 5, the load current detector 24 includes an operational amplifier (op-amp) 150 acting as an error amplifier to compare a reference current 152 and a load current 154. The op-amp 150 may be embodied by any device suitable for comparing the reference current 152 and load current 154, including active devices and passive devices including standard comparator integrated circuits. The op-amp 150 is referred to herein generically as a comparator, and the term comparator should be interpreted as including and encompassing any device, including active and passive devices, for comparing the reference current 152 and load current 154. The reference current 152 may be supplied by a transistor such as bipolar junction transistor (BJT) 156 connected in series with resistor 160 to the input voltage 16. A resistor 162 and a resistor 164 are connected in series between the input voltage 16 and the circuit ground 84, forming a voltage divider with a central node 166 connected to the base 170 of the BJT 156. The BJT 156 and resistor 160 act as a constant current source that is varied by the voltage on the central node 166 of the voltage divider 162 and 164, which is in turn dependent on the input voltage 16. A capacitor 172 may be connected between the input voltage 16 and the central node 166 to form a time constant if desired or needed for voltage changes at the central node 166. The universal dimmer 10 in this embodiment thus responds to the average voltage of input voltage 16 rather than the instantaneous voltage. In one particular embodiment, the local ground 86 floats at about 10 V below the input voltage 16 at a level established by the load 26. A capacitor 174 may be connected between the input voltage 16 and the local ground 86 to smooth the voltage powering the load current detector 24 if desired. A Zener diode 176 may also be connected between the input voltage 16 and the central node 166 to set a maximum load current 154 by clamping the reference current that BJT 156 can provide to resistor 190. In other embodiments, the load current detector 24 may have its current reference derived by a simple resistive voltage divider, with suitable AC input voltage sensing, level shifting, and maximum clamp, rather than BJT 156.

The load current 154 (meaning, in this embodiment, the current through the load 26 and through the capacitor 110 connected in parallel with the load 26) is measured using the load current sense resistor 94. The capacitor 110 can be configured to either be connected through the sense resistor 94 or bypass the sense resistor 94. The current measurement 180 is provided to an input of the error amplifier 150, in this case, to the non-inverting input 182. A time constant is applied to the current measurement 180 using any suitable device, such as the RC lowpass filter made up of the series resistor 184 and the shunt capacitor 186 to the local ground 86 connected at the non-inverting input 182 of the error amplifier 150. As discussed above, if needed, any suitable device for establishing the desired time constant or time constants may be used such that the load current detector 24 disregards rapid variations in the load current 154 due to the pulses from the variable pulse generator 20 and any regular waveform of the input voltage 16. The load current detector 24 thus substantially filters out changes in the load current 154 due to the pulses, averaging the load current 154 such that the load current detector output 200 is substantially unchanged by individual pulses at the variable pulse generator output 100.

The reference current 152 is measured using a sense resistor 190 connected between the BJT 156 and the local ground 86, and is provided to another input of the error amplifier 150, in this case, the inverting input 192. The error amplifier 150 is connected as a difference amplifier with negative feedback, amplifying the difference between the load current 154 and the reference current 152. An input resistor 194 is connected in series with the inverting input 192 and a feedback resistor 196 is connected between the output 200 of the error amplifier 150 and the inverting input 192. A capacitor 202 is connected in series with the feedback resistor 196 between the output 200 of the error amplifier 150 and the inverting input 192 and an output resistor 204 is connected in series with the output 200 of the error amplifier 150 to further establish a time constant in the load current detector 24. Again, the load current detector 24 may be implemented in any suitable manner to measure the difference of the load current 154 and reference current 152, with a time constant or time constants being included in the load current detector 24 such that changes in the load current 154 due to pulses are disregarded while variations in the input voltage 16 other than any regular waveform of the input voltage 16 are tracked.

The output 200 from the error amplifier 150 is connected to the level shifter 74, in this case, an opto-isolator, through the output resistor 204 to shift the output 200 from a signal that is referenced to the local ground 86 to a signal 206 that is referenced to the circuit ground 84 or to another internal reference point in the variable pulse generator 20. A Zener diode 210 and series resistor 212 may be connected between the input voltage 16 and the input 208 of the level shifter 74 for overvoltage protection. If the voltage across load 26 rises excessively, the Zener diode 210 will conduct, turn on the level shifter 74 and reduce the pulse width or stop the pulses from the variable pulse generator 20. In this embodiment, there are thus two parallel control paths, the error amplifier 150 to the level shifter 74 and the overvoltage protection Zener diode 210 to the level shifter 74.

The error amplifier 150 operates in an analog mode. During operation, as the load current 154 rises above the reference current 152 establishing the maximum allowable load current, the voltage at the output 200 of the error amplifier 150 increases, causing the variable pulse generator 20 to reduce the pulse width or stop the pulses from the variable pulse generator 20. As the output 200 of the error amplifier 150 rises, the pulse width becomes narrower and narrower until the pulses are stopped altogether from the variable pulse generator 20. The error amplifier 150 produces an output proportional to the difference between the average load current 154 and the reference current 152, where the reference current 152 is proportional to the average input voltage 16.

As discussed above, pulses from the variable pulse generator 20 turn on the switch 104, in this case a power FET via a resistor 214 to the gate of the FET 104. This allows current 154 to flow through the load 26 and capacitor 110, through the load current sense resistor 94, the inductor 112, the switch 104 and current sense resistor 114 to circuit ground 84. In between pulses, the switch 104 is turned off, and the energy stored in the inductor 112 when the switch 104 was on is released to resist the change in current. The current from the inductor 112 then flows through the diode 116 and back through the load 26 and load current sense resistor 94 to the inductor 112. Because of the time constant in the load current detector 24, the load current 154 monitored by the load current detector 24 is an average of the current through the switch 104 during pulses and the current through the diode 116 between pulses.

Figure 6:
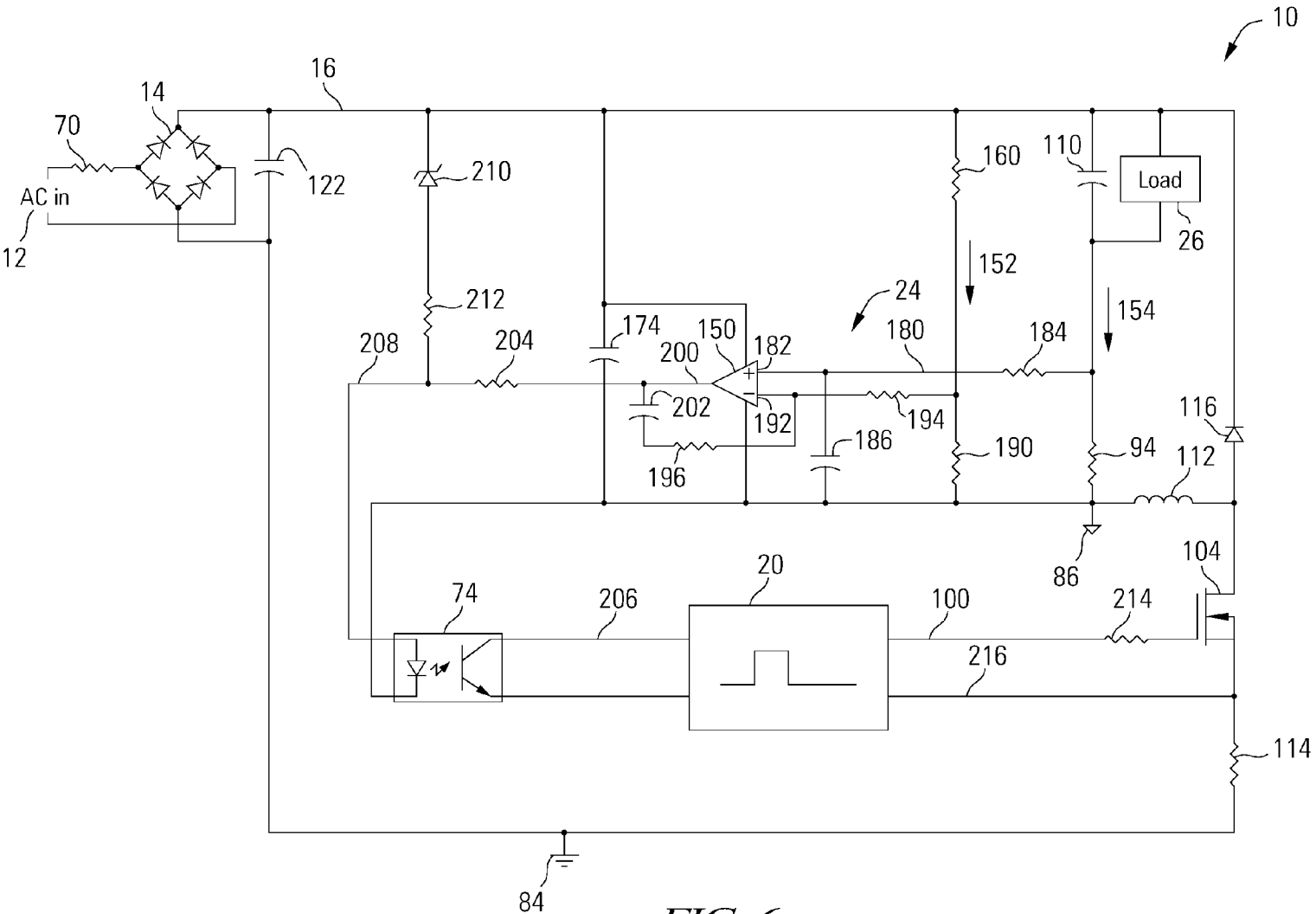
FIG. 6 depicts a schematic of a universal dimmer power supply/driver in accordance with some embodiments.

In another embodiment illustrated in FIG. 6, resistor 160 operates as a voltage divider, omitting the transistor 170 and associated components.

The current through the universal dimmer 10 is monitored by the current sense resistor 114, with a current feedback signal 216 returning to the variable pulse generator 20. If the current exceeds a threshold, maximum, limiting value, the pulse width is reduced or the pulses are turned off in the variable pulse generator 20. Generally, current sense resistors 94 and 114 may have low resistance values in order to sense the currents without substantial power loss. Thermal protection may also be included in the variable pulse generator 20, narrowing or turning off the pulses if the temperature climbs or if it reaches a threshold value, as desired. Thermal protection may be provided in the variable pulse generator 20 in any suitable manner, such as using active temperature monitoring, or integrated in the overcurrent protection by gating a BJT or other such suitable devices, switches and/or transistors with the current feedback signal 216, where, for example, the BJT exhibits negative temperature coefficient behavior. In this case, the BJT would be easier to turn on as it heats, making it naturally start to narrow the pulses.

In one particular embodiment the load current detector 24 turns on the output 200 to narrow or turn off the pulses from the variable pulse generator 20, that is, the pulse width is inversely proportional to the load current detector output 200. In other embodiments, this control system may be inverted so that the pulse width is directly proportional to the load current detector output 200. In these embodiments, the load current detector 24 is turned on to widen the pulses. This pulse widening may be used in applications where this feature is desirable.

Figure 7:
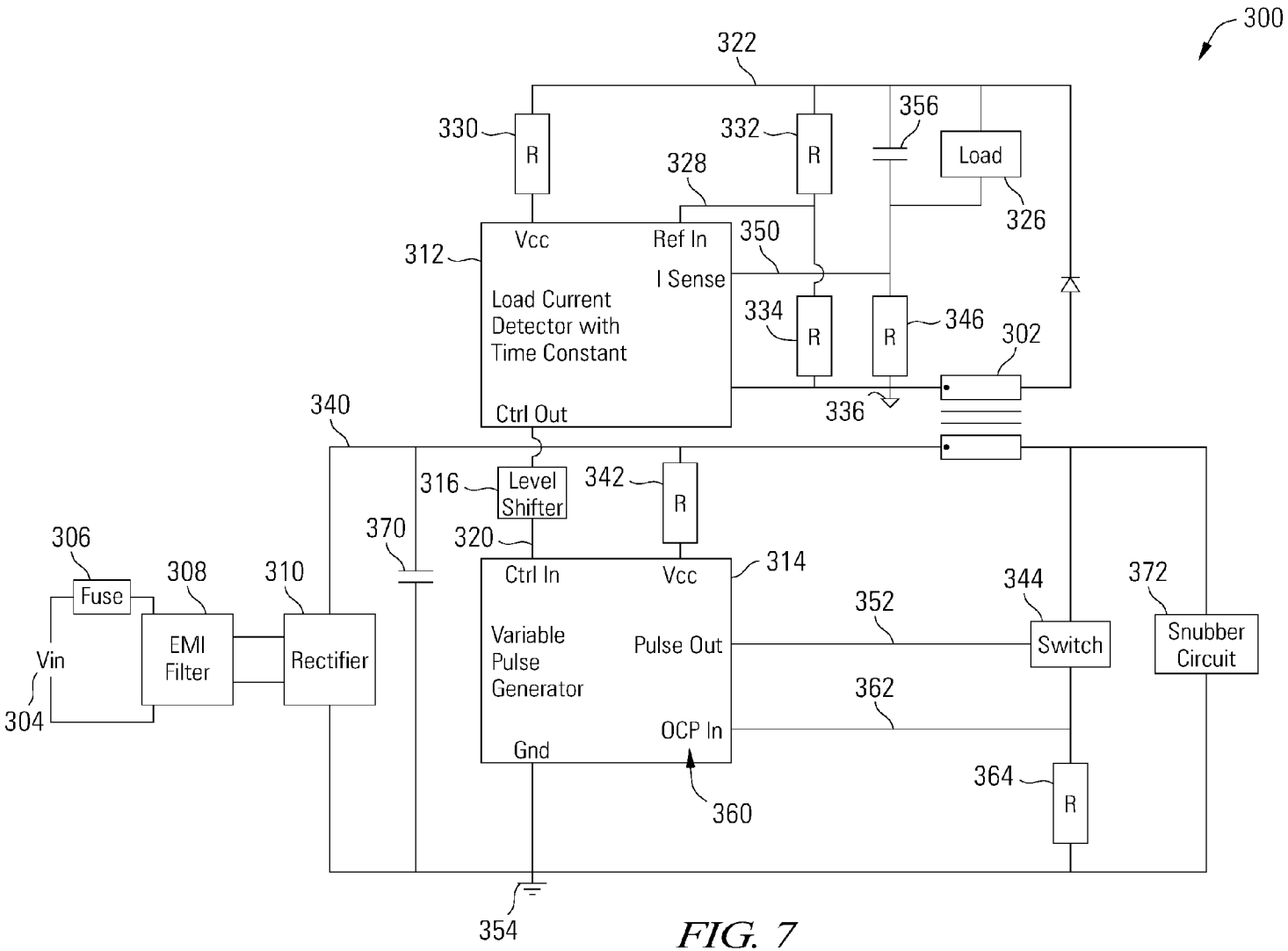
FIG. 7 depicts a schematic of a dimmer power supply with a transformer for isolation in flyback mode in accordance with some embodiments.
Figure 8:
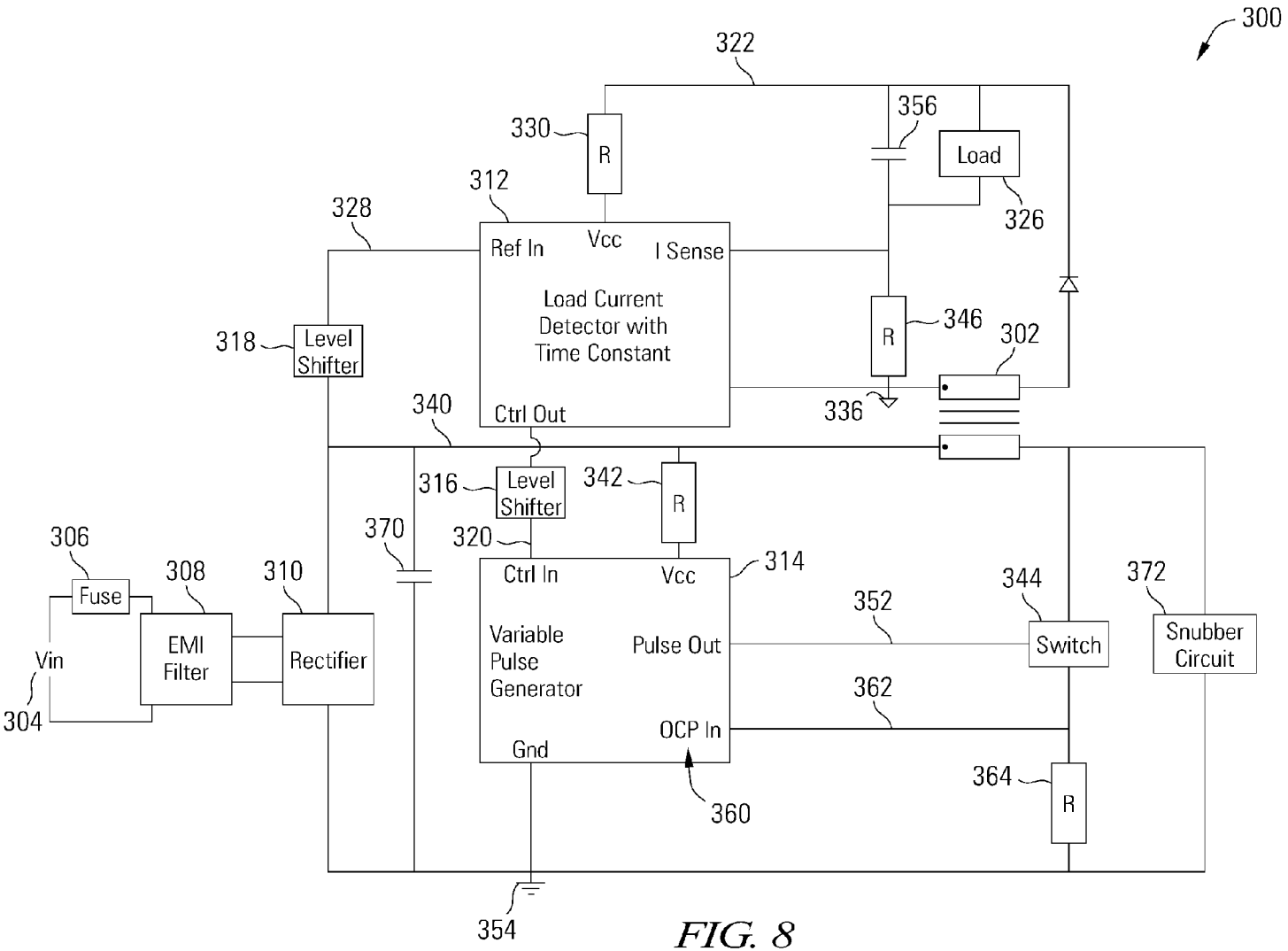
FIG. 8 depicts a schematic of a universal dimmer power supply/driver with a transformer for isolation in flyback mode in accordance with some embodiments.

In applications where it is useful or desired to have isolation between the load and the input voltage source, a transformer can be used in place of the inductor. The transformer can be of essentially any type including toroidal, C or E cores, or other core types and, in general, should be designed for low loss. The transformer can have a single primary and a single secondary coil or the transformer can have either multiple primaries and/or secondaries or both including one or more bias and/or auxiliary coils to provide power to various parts of the dimmer power supply driver. FIG. 7 illustrates one embodiment using a transformer in the flyback mode of operation to realize a highly efficient circuit with very high power factor approaching unity and with isolation between the AC input and the LED output. Such an embodiment can also readily support internal dimming as illustrated in FIG. 8.

Referring now to FIG. 7, a power supply 300 with a transformer 302 will be described. An AC input 304 is shown, and is connected to the universal dimmer 300 in this embodiment through a fuse 306 and an electromagnetic interference (EMI) filter 308. As in previously described embodiments, the fuse 306 may be any device suitable to protect the universal dimmer 300 from overvoltage or overcurrent conditions. The AC input 304 is rectified in a rectifier 310. In other embodiments, the universal dimmer 300 may use a DC input. The universal dimmer 300 may generally be divided into a high side portion including the load current detector 312 and a low side portion including the variable pulse generator 314. The high side portion is connected to one side of the transformer 302, such as the secondary winding, and the low side portion is connected to the other side of the transformer 302, such as the primary winding. A level shifter 316 is employed between the load current detector 312 in the high side and the variable pulse generator 314 in the low side to communicate the control signal 320 to the variable pulse generator 314. The high side has a node that may be considered a power input 322 for the output driver, although the power for the power input 322 is derived in this embodiment from the transformer 302. The load 326 receives power from the power input 322. The load current detector 312 is also powered from the power input 322 (although an additional bias coil could be used on the transformer to provide this power and voltage) through a resistor 330, and a reference current 328 for the load current detector 312 is generated by a voltage divider having resistors 332 and 334 connected in series between the power input 322 and a high side or local ground 336. The variable pulse generator 314 is powered from a low side input voltage 340 through a resistor 342, for which another bias coil could also be used if so desired, and a switch 344 driven by pulses from the variable pulse generator 314 turns on and off current through the transformer 302. The power supply voltage to the load current detector 312 may be regulated in any suitable manner, and the reference current input 328 may be stabilized as desired. For example, a voltage divider with a clamping Zener diode may be used as in previous embodiments, a precision current source may be used in place of the resistor 332 in the voltage divider, a bandgap reference source may be used, etc. Note that it is important in dimmable embodiments for the input voltage 340 to be a factor in the reference current input 328 such that this input 328 is clamped at some maximum value as the input voltage 340 rises, yet is allowed to fall as input voltage 340 drops (suitably filtered to reject the AC line frequency) for use in, for example, control during dimming embodiments.

In the high side, as current flows through the load 326, a load current sense resistor 346 provides a load current feedback signal 350 to the load current detector 312. The load current detector 312 compares the reference current signal 328 with the load current signal 350 using, in the present embodiment shown, a time constant to effectively average out and disregard current fluctuations due to any waveform at the power input 322 and pulses from the variable pulse generator 314 through the transformer 302, and generates the control signal 320 to the variable pulse generator 314, gradually turning on the control signal 320 as needed to cause the variable pulse generator 314 to reduce the pulse width at the pulse output 352 of the variable pulse generator 314 as needed to keep the load current from rising above the maximum allowed level. When the load current is below the maximum allowed level, the load current detector 312 turns off the control signal 320 to permit free-running dimming. The level shifter 316 shifts the control signal 320 from the load current detector 312 which is referenced to the local ground 336 by the load current detector 312 to a level shifted control signal that is referenced to the circuit ground 354 for use by the variable pulse generator 314. The level shifter 316 may comprise any suitable device for shifting the voltage of the control signal 320 between isolated circuit sections, such as an opto-isolator, opto-coupler, resistor, transformer, etc.

The pulse output 352 from the variable pulse generator 314 drives the switch 344, allowing current to flow through the transformer 302 and powering the high side portion of the universal dimmer 300. As in some other embodiments, any suitable frequency for the pulses from the variable pulse generator 314 may be selected for the present embodiments shown in this figure, with the time constant in the load current detector 312 being selected to disregard load current changes due to the pulses from the variable pulse generator 312 while tracking changes on the input voltage 322 that are slower than or on the order of the waveform on the input voltage 322. In other embodiments, the time constant can also be incorporated into the pulse generator circuit. Changes in the current through the load 326 due to the pulses from the variable pulse generator 314 may be smoothed in the optional capacitor 356, or may be ignored if the load is such that high frequency changes are acceptable. Current overload protection 360 may be included in the variable pulse generator 314 based on a current measurement signal 362 by a current sense resistor 364 connected in series with the switch 344. If the current through the switch 344 and the current sense resistor 364 exceeds a threshold value or limit or maximum set in the current overload protection 360, the pulse width at the pulse output 352 of the variable pulse generator 314 will be reduced or eliminated. A suitable line capacitor 370 may be included between the input voltage 340 and circuit ground 354 to smooth the rectified input waveform if desired or this capacitor may be reduced or eliminated depending on the particular situation, application, etc. A snubber circuit 372 may be included in parallel, for example, with the switch 344 if desired to suppress transient voltages in the low side circuit. It is important to note that the universal dimmer 300 is not limited to the flyback mode configuration illustrated in FIG. 7, and that a transformer or inductor based universal dimmer 300 may be arranged in any desired topology.

Referring now to FIG. 8, the power supply 300 with a transformer 302 may be adapted for dimmability by providing level-shifted feedback from the AC input voltage 340 to the load current detector 312. The level shifter 318 may comprise any suitable device as with other level shifters (e.g., 316). The level-shifted feedback enables the load current detector 312 to sense the AC input voltage 340 so that it can provide a control signal 320 that is proportional to the dimmed AC input voltage 340.

Figure 9:
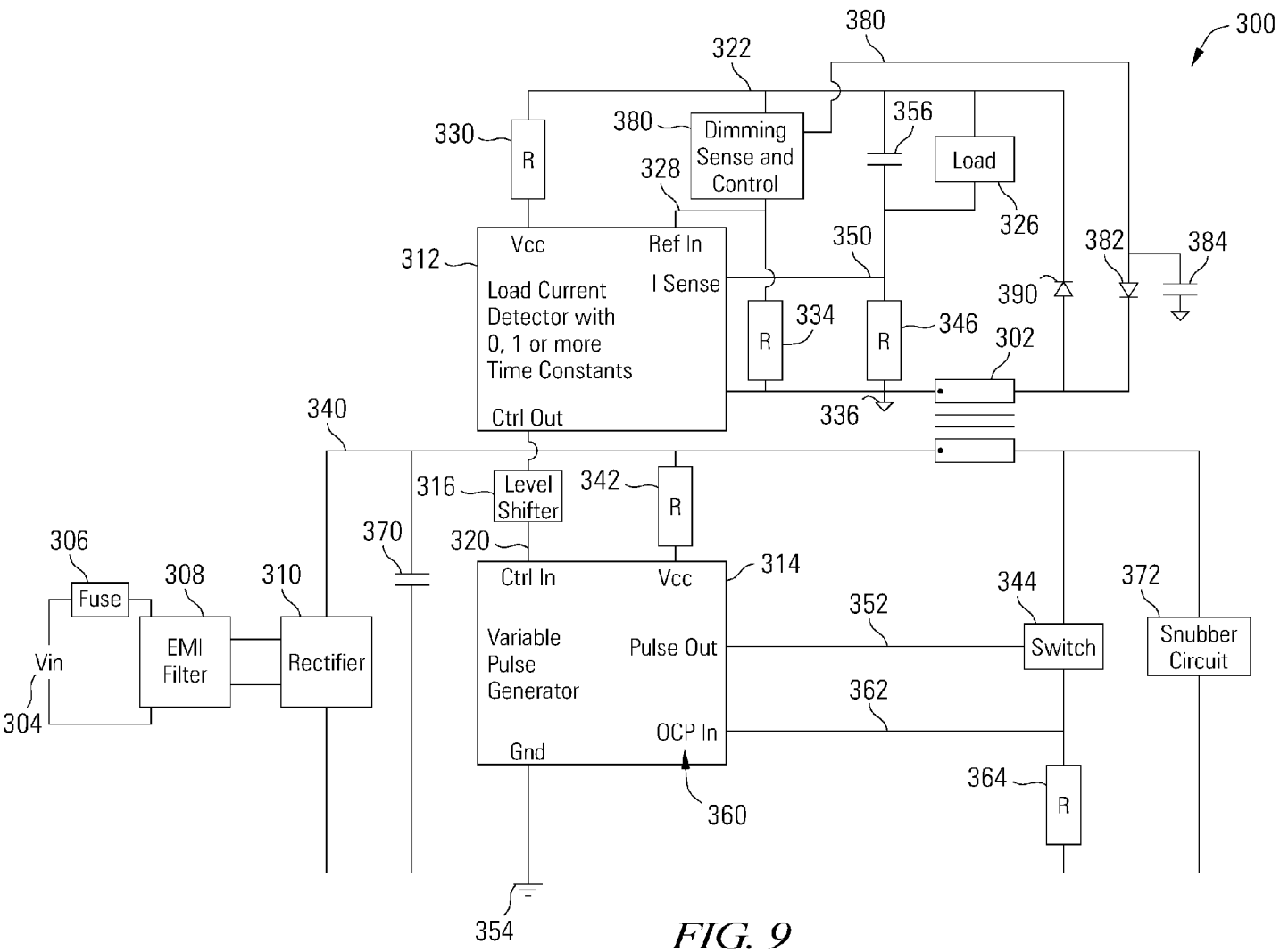
FIG. 9 depicts a schematic of a universal dimmer power supply/driver with a transformer for isolation in accordance with some embodiments.

Referring now to FIG. 9, the universal dimmer 300 may also include an internal dimmer 380, for example, to adjustably attenuate any of a number of reference or feedback currents. In the embodiment of FIG. 8, the universal dimmer 300 is placed to provide adjustable control (i.e. control during dimming) of the level of the reference current 328. The reference current 328 generated by the internal dimmer 380 may be based on the input voltage 340 in the low side or primary side of the universal dimmer 300 via a feedback signal 380 through the transformer 302, including for example the instantaneous or average input voltage, the phase/on-time of the input voltage, etc. or any combination or single individual parameter. Diode 382 may be included to ensure that current on the internal dimmer 380 flows only in one direction, and capacitor 384 may be added to introduce a time constant on the internal dimmer 380 if needed and as desired. For example, referring to FIGS. 7 and 10 simultaneously, if the high side of the universal dimmer 300 of FIG. 8 were configured similar to that of the universal dimmer 10 of FIG. 5, the bottom of resistor 164 may be connected to the internal dimmer 380 rather than to the circuit ground 84. Note also that diode 390 may not be needed if the universal dimmer 300 is not configured for operation in flyback mode.

Figure 10:
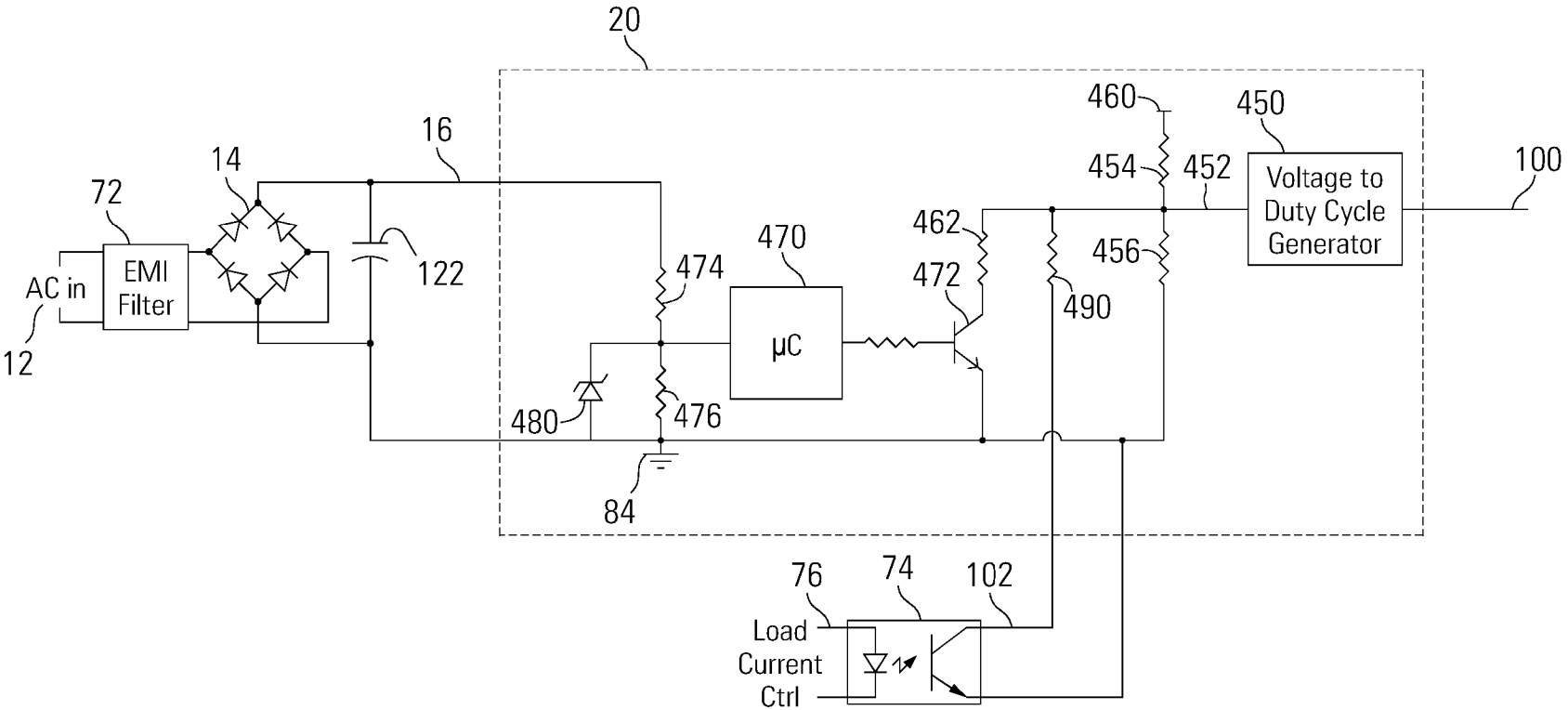
FIG. 10 depicts a schematic of a one example of a variable pulse generator that supports universal dimming in accordance with some embodiments.

One example of a variable pulse generator 20 and 314 that supports universal dimming is illustrated in FIG. 10, although it is important to note that the variable pulse generator 20 and 314 may be adapted in any suitable manner to limit the input voltage as needed to cap the output current given various different input voltages or input voltage ranges. In this example embodiment, the variable pulse generator 20 is adapted with several mechanisms for limiting the pulse width at the pulse output 100. The pulse train is generated by a voltage to duty cycle pulse generator 450, which adjusts the duty cycle or pulse width proportionally to the voltage at the input 452. As the voltage increases, the pulse width or duty cycle increases. The free-running non-limited pulse width is established by a bias voltage at the input 452, such as that produced by divider resistors 454 and 456 from a reference voltage 460. For example, a 15V reference voltage 460 may be used with 100 kΩ and 30 kΩ resistors 454 and 456 to produce a bias voltage at the input 452 of about 3.5V for a maximum pulse width. Various mechanisms may be used to lower the voltage at the input 452 during over-current or over-temperature conditions, for example.

One such mechanism in the example embodiment of FIG. 10 is the addition of another slope resistor 462 in parallel with the first slope resistor 456 if the input voltage rises above a particular level. For example, the variable pulse generator 20 may be adapted to operate with either a 120 VAC input or a 240 VAC input and to detect which is being used. By connecting a second 30kΩ slope resistor 462 in parallel with the first slope resistor 456, the voltage at the input 452 to the pulse generator 450 is cut in half and the rate of increase in the duty cycle slope is cut in half as the input voltage is dimmed. Note that when the input voltage is dimmed by an external dimmer, the input voltage range is either 0VAC-120VAC or 0VAC-240VAC in the present example.

Any suitable mechanism for connecting the second slope resistor 462 (or otherwise changing the value of the first slope resistor 456) may be used. For example, a microcontroller 470 or suitable alternatives may monitor the input voltage 16 and turn on a transistor 472 such as an NPN bipolar transistor to connect the second slope resistor 462. Such alternatives may include microprocessors, state machines, digital logic, analog and digital logic, application specific integrated circuits (ASICs), field programmable gate arrays (FPGAs), configurable logic devices (CLDs), etc. In this example, the microcontroller 470 monitors the input voltage 16 using an analog to digital converter (ADC) input connected to the input voltage 16 through voltage divider resistors 474 and 476, which scale the expected maximum voltage of 240 VAC (rectified to about 340 VDC) at the input voltage 16 to the maximum input level of the ADC, or about 3 VDC or a bit below. A Zener diode 480 may be connected to the ADC to limit the input voltage to the maximum supported by the microcontroller 470 to prevent damage to the microcontroller 470. When operating at 120 VAC input and dimmed fully on, the input to the ADC in the microcontroller 470 is about 1.5 VDC. The microcontroller 470 in this example is programmed to turn on the transistor 472 and connect the second slope resistor 462 when the input voltage rises above about 1.5 VDC, meaning that the AC input 12 is above about 120 VAC. The variable pulse generator 20 may be adapted if desired to perform this input voltage detection and secondary slope resistor switching only periodically or only at startup, and to keep the secondary slope resistor 462 active once connected until the next power cycle, to avoid switching back and forth between input voltage ranges and flashing the LEDs. Note that MOSFETs, junction FETs, any most any other type of transistor could be used in place of the BJT 472 shown in FIG. 10.

A similar mechanism may be used to reduce or limit the pulse width when the load current reaches its maximum allowable value. When the load current detector 24 (e.g., FIG. 4) determines that the load current has reached the maximum value, it begins to turn on the load current control signal 76. The control signal 76 is level shifted or isolated as needed by a device such as the level shifter 74. A third slope resistor 490 is connected in series with the level shifter 74 output across the first slope resistor 456, so that as the level shifter 74 is activated, it lowers the effective resistance between the pulse generator input 452 and circuit ground 84, reducing the voltage at the pulse generator input 452. The level shifter 74 is turned on in analog fashion by the load current detector 24, turning on more strongly as the load current rises above the maximum allowable level. The third slope resistor 490 is given a value low enough to turn off the pulses or restrict them as desired to protect the load from excessive current. For example, the third slope resistor 490 may be a 1 kΩ, so that when the level shifter 74 is only slightly turned on, the combination of the third slope resistor 490 and the level shifter 74 may present a 30 kΩ resistance in parallel with the first slope resistor 456, and when the level shifter 74 is fully on, 1 kΩ is connected in parallel with the first slope resistor 456.

The low side current overload protection 50 (e.g., FIG. 4) may operate in similar fashion, for example turning on a bipolar transistor to connect a low resistance across the first slope resistor 456 to turn off or restrict the pulse width at the pulse output 100. Note that an optional capacitor may be added between 452 and 84 to facilitate time constant implementation that can be overridden by the detection of an overcurrent condition either in the LED current path or in the AC (or DC) input current path, or by other parameters or conditions, etc. By a similar token, embodiments of the present invention can be designed and implemented that allow universal dimming based on the on-time phase of either a conventional triac dimmer or a forward or reverse phase non-triac dimmer by using the circuit shown in FIG. 10 (i.e., 476 and 474 in a more digital mode in which the on-time of the dimmer is determined and the present invention dimmer power supply driver produces an output current proportional to the phase angle on-time. In addition, the optocoupler 74 of, for example, FIG. 6 can also be configured and used in a digital on/off fashion rather than as in an analog fashion as illustrated in the embodiments and implementations shown. Again, nothing in this document should be construed or viewed as limiting in any way or form for the present universal dimmer power driver invention discussed here.

Figure 11:
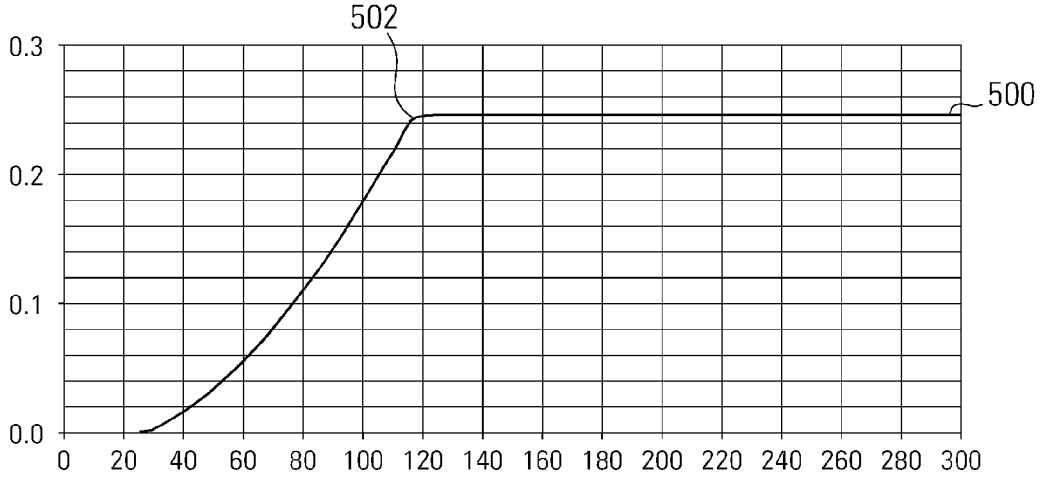
FIG. 11 depicts a plot of output current versus input voltage in a universal dimmer power supply/driver in accordance with some embodiments, wherein the universal dimmer power supply/driver is adjusted for full brightness at 120VAC input.

The operation of the universal dimmer 10 is graphically illustrated in the current plot of FIG. 11. Input voltage is plotted on the X-axis, output current is plotted on the Y-axis, and the plotted line 500 represents the load current. In the example of FIG. 11, the universal dimmer 10 is adapted to limit the load current at about 0.243 A, and the variable pulse generator 20 is set at an input voltage range of about 0 VAC-120 VAC. As the input voltage increases, the output current increases until the input voltage reaches about 120 VAC, at which point the load current level hits a shoulder 502 and is limited. By adding in the second slope resistor 462 in the variable pulse generator 20 in the example described above, the shoulder 502 would be shifted to the right in the plot of FIG. 12, moving the maximum load current and full brightness level up to about 240 VAC.

Figure 12:
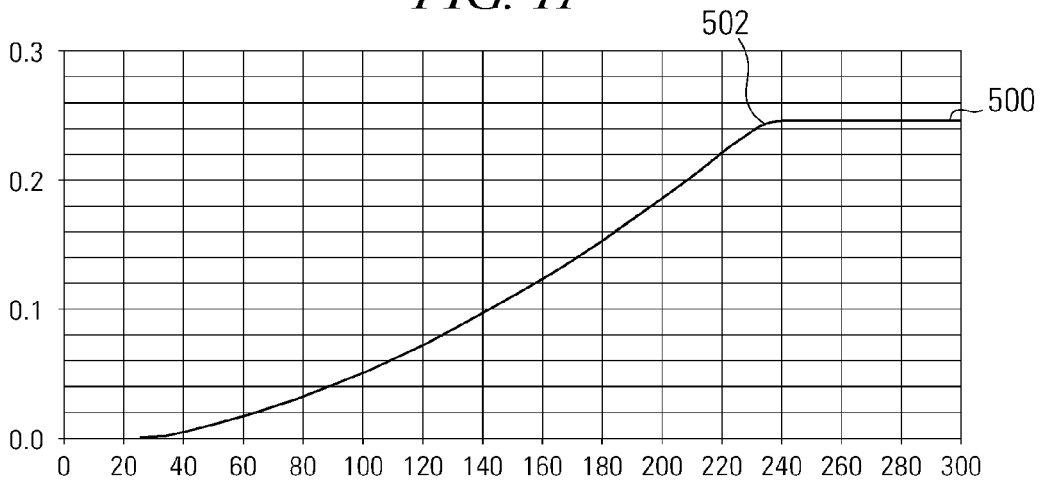
FIG. 12 depicts a plot of output current versus input voltage in a universal dimmer power supply/driver in accordance with some embodiments, wherein the universal dimmer power supply/driver is adjusted for full brightness at 240 VAC input.
Figure 13:
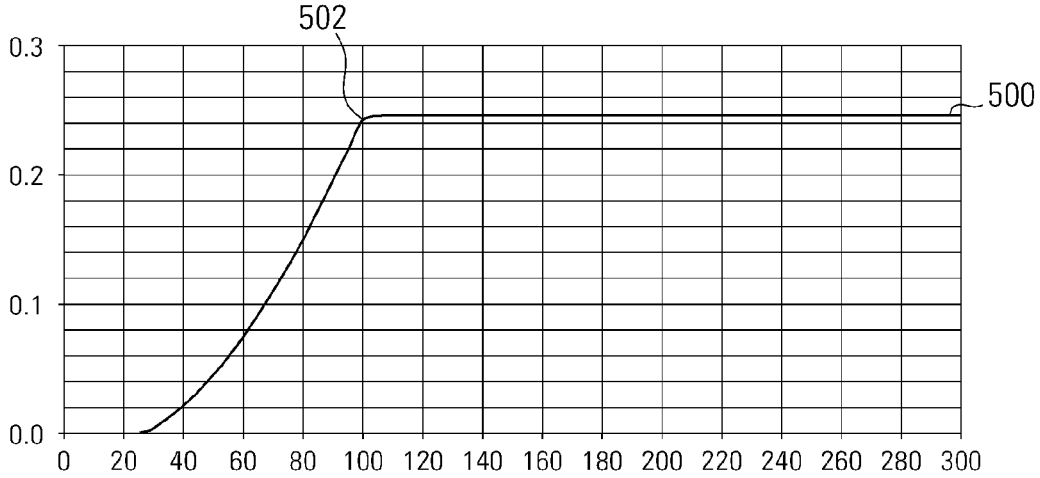
FIG. 13 depicts a plot of output current versus input voltage in a universal dimmer power supply/driver in accordance with some embodiments, wherein the universal dimmer power supply/driver is adjusted for full brightness at 100 VAC input.

Note that because line voltage levels may vary, it may be desirable to set the shoulder 502 to a slightly lower level, allowing the universal dimmer 10 to reach full brightness even if the line voltage is on the low edge of normal. For example, in the plot of FIG. 13, the shoulder 502 is set at about 100 VAC, allowing the light to reach full brightness when the dimmer is set at 100%, even if the line voltage is a bit lower than the normal 110 VAC-120 VAC. Note also that the start point of about 30 VAC when the load current begins to turn on in FIGS. 11-13 is merely an example, and the universal dimmer 10 may be adapted to begin turning on at any practical input voltage level desired. Of course, FIGS. 11 through 13 are meant to merely illustrate some exemplary implementations and are in no way or form limiting of the present invention. Universal dimming as shown in the present invention can be used to cover the range below 100V to greater than 480 VAC in embodiments and implementations of the present invention taught.

In another embodiment of the universal dimmer 10, the microcontroller 470 (or one of the many suitable alternatives as discussed above) controls the load current based on phase angle/duty cycle of the input voltage 16, rather than on a determination of when the input voltage 16 reaches or exceeds a threshold or limit value. In this embodiment, the microcontroller 470 may be shifted into the secondary/load side of the universal dimmer 10 to directly control the load current level based on the duty cycle on the AC input 12, as it is adjusted by an external dimmer such as a triac based dimmer. The values of the voltage divider resistors 474 and 476 are adapted so that they operate in conjunction with the Zener diode 480 to present an asserted signal to the microcontroller 470 during the "on" portion of the cycle at the AC input 12, and a logical low signal to the microcontroller 470 during the "off" portion of the cycle at the AC input 12. Although the rectifier 14 and capacitor 122 do perform some signal conditioning as well as rectification of the AC input 12, the universal dimmer 10 may be adapted to maintain enough of the original signal to detect when the AC input 12 is on and when it is off. The microcontroller or other such control unit such as a microprocessor, ASIC, FPGA, etc. may be configured to produce an output signal (i.e., voltage reference signal that is further voltage divided down in an exemplarily implementation) that can, for example, be proportional to the input phase on-time or can be any practical function of the input phase on-time including squared, square-rooted, power law, logarithmic, sub-linear, etc.

The dimming to universal invention presented here can be accomplished with a number of approaches including but not limited to those listed below associated with, for example, an input voltage variable signal that reaches a maximum level at a certain set or value of, for example, input voltage level or conditions (e.g. input voltage reaches 120 VAC root mean square (RMS):

- Control on high (output) side with two or more time constants
- Control on high (output) side with fast feedback to bypass time constant when set current is exceeded
- Control on high (output) side with two or more time constants with fast feedback to bypass time constant when set current is exceeded
- No capacitor on the output side
- No time constant on the output side
- Voltage controlled output with current limit
- DC (low ripple) circuit on high side
- Dimming control on high side
- Wireless control and monitoring
- Wireless PWM controller
- AND gates and/or transistor switches, etc. to limit/turn-off PWM
- More complicated Boolean algebra and state/timing approaches to control and limit current
- Control on high (output) side with slow feedback (can be more than one time constant)
- Control on high side with fast response but slow time constant on low side
- Digital control on high (output) side
- Wall Dimming to digital/analog dimming
- Wall Dimming to wireless dimming
- AC input transformer
- Combination of wall dimming and other types of analog and digital dimming, with communication and control including but not limited to wired and wireless interfaces, such as a digital addressable lighting interface (DALI), 0 to 10 V DC analog, pulse width modulation (PWM), digital multiplexing (DMX), powerline dimming, etc.

The above is merely meant to provide illustrative examples and should not be construed or taken as limiting in any or form for the present invention.

What is claimed is:

1. A dimming power supply comprising:

a power limiting switch connected to an input voltage supply;

an output driver having a power input and a load path, the power input being connected to the input voltage supply;

a variable pulse generator having a control input and a pulse output, the pulse output being connected to a control input of the power limiting switch, wherein the variable pulse generator is adapted to effectively vary a duty cycle at the pulse output; and a load current detector having an input and an output, the input being connected to the output driver load path and the output being connected to the variable pulse generator control input, wherein the variable pulse generator and the load current detector are adapted to limit the duty cycle when a load current reaches a maximum current limit to substantially prevent the load current from exceeding the maximum current limit.

2. The dimming power supply of claim 1, wherein the output driver is connected to the input voltage supply through a transformer, and wherein the power limiting switch is connected in series with the transformer across the input voltage supply.

3. The dimming power supply of claim 1, wherein the output driver comprises:

an inductor connected at a first node to a local ground, and wherein the power limiting switch is connected between the inductor and a ground; and a diode connected between the power input of the output driver and a second node of the inductor, wherein the load path is located between the power input of the output driver and the first node of the inductor.

4. The dimming power supply of claim 1, wherein the variable pulse generator is adapted to select between a plurality of input voltage levels at which a maximum duty cycle is generated at the pulse output.

5. The dimming power supply of claim 4, wherein the variable pulse generator is adapted to detect a voltage level at the input voltage supply and to select between the plurality of input voltage levels at which a maximum duty cycle is generated at the pulse output based on the voltage level at the input voltage supply.

6. The dimming power supply of claim 4, wherein the variable pulse generator comprises:

a voltage to duty cycle pulse generator having an input and an output, the voltage to duty cycle pulse generator output being connected to the pulse output; and a voltage divider having an upper impedance and a lower impedance connected in series between an upper reference voltage and a lower reference voltage, the voltage divider having an output between the upper impedance and the lower impedance, the voltage divider output being connected to the voltage to duty cycle pulse generator input.

7. The dimming power supply of claim 6, wherein the variable pulse generator further comprises:

an input voltage monitor connected to the input voltage supply; and a secondary lower impedance switchably connected in parallel with the lower impedance, wherein the input voltage monitor connects the secondary lower impedance in parallel with the lower impedance when the input voltage supply rises to a predetermined level.

8. The dimming power supply of claim 7, wherein the input voltage monitor comprises an A/D converter and comparator, and wherein the secondary lower impedance is switchably connected by a transistor in series with the secondary lower impedance.

9. The dimming power supply of claim 8, wherein the A/D converter and comparator comprise a microcontroller.

10. The dimming power supply of claim 6, wherein the variable pulse generator further comprises a load current controlled lower impedance switchably connected in parallel with the lower impedance, wherein the load current detector is adapted to connect the load current controlled lower impedance in parallel with the lower impedance in analog fashion, with an impedance of the load current controlled lower impedance being inversely proportional to an amount by which the load current exceeds the maximum current limit.

11. The dimming power supply of claim 10, wherein the load current controlled lower impedance comprises a resistor in series with an optocoupler output side, connected in parallel with the lower impedance, wherein an input side of the optocoupler is driven by the load current detector output.

12. The dimming power supply of claim 1, further comprising an input power duty cycle monitor connected to the input voltage supply, wherein the input power duty cycle monitor is adapted to control the load current based on a duty cycle of the input voltage supply.

13. The dimming power supply of claim 1, further comprising an input power duty cycle monitor connected to the input voltage supply, wherein the input power duty cycle monitor is adapted to control the load current based on a phase clipping status of the input voltage supply.

14. The dimming power supply of claim 12, wherein the input power duty cycle monitor comprises a voltage divider and Zener diode connected to the input voltage supply, wherein the voltage divider and Zener diode indicate when the voltage at the input voltage supply is zero and when the voltage at the input voltage supply is nonzero.

15. The dimming power supply of claim 12, wherein the input power duty cycle monitor generates an output signal that is a function of an input phase on-time of the input voltage supply.

16. The dimming power supply of claim 15, wherein the function consists of an element selected from the group consisting of squared, square-rooted, power law, logarithmic, and sub-linear.

* * * * *